US006543058B2

(12) United States Patent
Litke

(10) Patent No.: US 6,543,058 B2
(45) Date of Patent: Apr. 8, 2003

(54) GLOVE WITH AN EXOSKELETON LAYER

(75) Inventor: Kenneth S. Litke, Marion, MA (US)

(73) Assignee: Acushnet Company, Fairhaven, MA (US)

( * ) Notice: Subject to any disclaimer, the term of this patent is extended or adjusted under 35 U.S.C. 154(b) by 0 days.

(21) Appl. No.: 09/898,939

(22) Filed: Jul. 3, 2001

(65) Prior Publication Data

US 2003/0005506 A1 Jan. 9, 2003

(51) Int. Cl.[7] ..... A41D 19/00
(52) U.S. Cl. ..... 2/161.2; 2/159; 2/169
(58) Field of Search ..... 2/16, 20, 159, 2/161.1, 161.2, 161.3, 161.4, 161.6, 162, 167, 169; 601/40; 602/21

(56) References Cited

U.S. PATENT DOCUMENTS

| | | | | |
|---|---|---|---|---|
| 3,123,832 A | | 3/1964 | Kubik | 2/161 |
| 4,701,963 A | | 10/1987 | Overton | 2/161 |
| 4,850,341 A | * | 7/1989 | Fabry et al. | 601/40 |
| 5,033,119 A | * | 7/1991 | Wiggins | 2/162 |
| 5,345,609 A | | 9/1994 | Fabry et al. | 2/20 |
| 5,708,979 A | | 1/1998 | Redwood et al. | 2/161 |
| 5,893,172 A | * | 4/1999 | Haynes et al. | 2/161.2 |
| 6,182,293 B1 | | 2/2001 | Mustin | 2/161 |

* cited by examiner

*Primary Examiner*—Gary L. Welch

(57) ABSTRACT

A glove with a front portion and a back portion coupled to the front portion. The back portion includes an exoskeleton layer. The exoskeleton layer is formed of elastic material and the glove may be configured to allow the user's hand to be visible through the exoskeleton layer. Alternatively, the back portion can include the exoskeleton and another layer of material disposed between the exoskeleton layer and the front portion. The additional layer of material can be formed substantially elastic material or of a combination of substantially elastic material and substantially inelastic material.

13 Claims, 4 Drawing Sheets

GLOVE WITH AN EXOSKELETON LAYER

FIELD OF THE INVENTION

The present invention relates to a glove that is designed to fit snugly on a user's hand, while also being sufficiently flexible to allow both static and dynamic hand positions and movement. More specifically, the present invention is related to a glove with an exoskeleton layer on a back portion.

BACKGROUND OF THE INVENTION

Some conventional gloves typically do not permit sufficient flexibility in the fingers to perform various sports movements, such as swinging a racquet, bat, or golf club, while maintaining a tight fit in the fingers. Many gloves that have some degree of flexibility in the fingers often do so by use of a thin material that disadvantageously wears through over a short time period. Some conventional gloves also do not offer the optimum level of breathability to keep wearer's hands comfortable and dry during use. In order to address these and other problems, some glove have been made with elastic material, particularly in the back of the glove. For example, the following patents describe gloves with a hand back that contains elastic material.

U.S. Pat. No. 3,123,832 discloses a bowling glove having a stiffening member that extends from the wrist band down to the fingers of the glove or slightly short thereof and is disposed medially of the glove. The stiffener is either secured directly to the back surface as by stitching or a suitable adhesive, for example. The stiffener is preferably elastic or resilient material capable of a two-way stretch so as to cause the glove to inherently tend to contract on the hand and thus fit snugly, as well as to impart stiffness or tension across the back of the hand to stiffen the fingers.

U.S. Pat. No. 4,701,963 to Overton discloses a glove with a backside that includes an expandable or stretchable insert that extends from the wrist cuff upwardly toward the thumb opening and spaced just inwardly from a thumb opening.

U.S. Pat. No. 5,345,609 to Fabry et al. discloses a protective glove having a back portion with at least one pocket with one or more hollow, fluid-filled shock-absorbing cells disposed therein. The cells are covered by inner and outer panels made of elastic fabric, which cooperate to form a closed pocket for a resilient, protective cellular material. The resilient panel holds the cellular material snugly in position, and is cut in substantially the same shape as the cellular material. The resilient panel then is superimposed therewith so that its edges are curled around and under the edges of the cellular material.

U.S. Pat. No. 5,708,979 to Redwood et al. discloses a glove with an elastic back. The glove includes a palm covering portion, a plurality of finger covering portions extending from the palm covering portion, and a back portion associated with the palm covering portion to form a chamber to receive a hand. The glove further includes elastic members extending from the back portion past and over at least one knuckle of each finger.

U.S. Pat. No. 6,182,293 to Mustin discloses a sports glove with a ball holding suction cup in the palm. The glove includes a body portion designed to fit in the palm of a human hand, a plurality of finger engaging portions, and a thumb engaging portion. Each finger and thumb engaging portion are of elastic material and further include a finger or thumb encircling ring.

There remains a need for other glove configurations that will provide sufficient levels of flexibility, wear resistance, and breathability, particularly for sports gloves.

SUMMARY OF THE INVENTION

The present invention is directed to a glove with a front portion and a back portion coupled thereto. The back portion includes an exoskeleton layer. The exoskeleton layer is formed of elastic material and the glove may be configured to allow the user's hand to be visible through the exoskeleton layer.

According to one embodiment of the present invention, the glove comprises a substantially inelastic front portion and a back portion coupled to the front portion. The back portion may comprise a first substantially elastic material, and a second substantially elastic material. The second elastic material may include a plurality of elastic members.

In such a glove, the first elastic material may form a first layer and the second elastic material may form a second layer overlaying at least a portion of the first layer. In addition, the second elastic material may extend substantially across the entire back portion.

According to another aspect of the present invention, the first and second elastic materials may be woven material, non-woven material, neoprene, LYCRA (a polyether urea manufactured by Du Pont of Wilmington Del.), Spandex, or polyesther urea, among others.

In another embodiment of the present invention, the back portion may be formed of a first layer of substantially elastic material joined to a substantially inelastic material and a second overlapping layer of substantially elastic material in the form of a plurality of elastic members.

Alternatively, in such a glove the plurality of elastic members may include at least two sets of members. The first set of members extends across the back portion and the second set of members extends along at least one of the finger portions. According to several embodiments of the present invention, the first and second sets of members may be formed of a single piece of material or as separate pieces.

In another embodiment, the additional sets of elastic members may extend along another or all of the remaining finger portions.

According to another aspect of the present invention, the first and second elastic materials may be woven material, non-woven material, neoprene, LYCRA, Spandex, or polyesther urea, among others.

The present invention is also directed to a glove comprising a front portion and a back portion. The back portion may be comprised of a plurality of elastic members coupled to the front portion at discrete points.

The present invention is also directed to a glove comprising a front portion and a back portion. The back portion may be comprised of a plurality of molded elastic members coupled to the front portion.

According to one aspect of this invention the elastic members form a network with at least one open interstice there between, where an area of each interstice may be greater than about 2 $mm^2$.

BRIEF DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

The present invention provides a glove that fits snugly and tightly around the user's hand in a comfortable manner. The balance of construction and materials with the static and dynamic nature of hand movements assures a durable and resilient fit. The glove of the present invention can be effectively skintight, which is substantially present throughout its life span. This advantage is due to the unique design and combination of construction materials described below, which provide a desirable comfort, fit, and wear resistance in one glove.

The snug, comfortable fit of the present invention is provided by use of a strong elastic material across the back of the hand. When combined with a hook and loop type closure, this arrangement provides a more accommodating fit on first use and allows the glove to adjust as the palm material expands. This same concept can be extended to the back of the fingers and thumb, as well.

Figure 1:
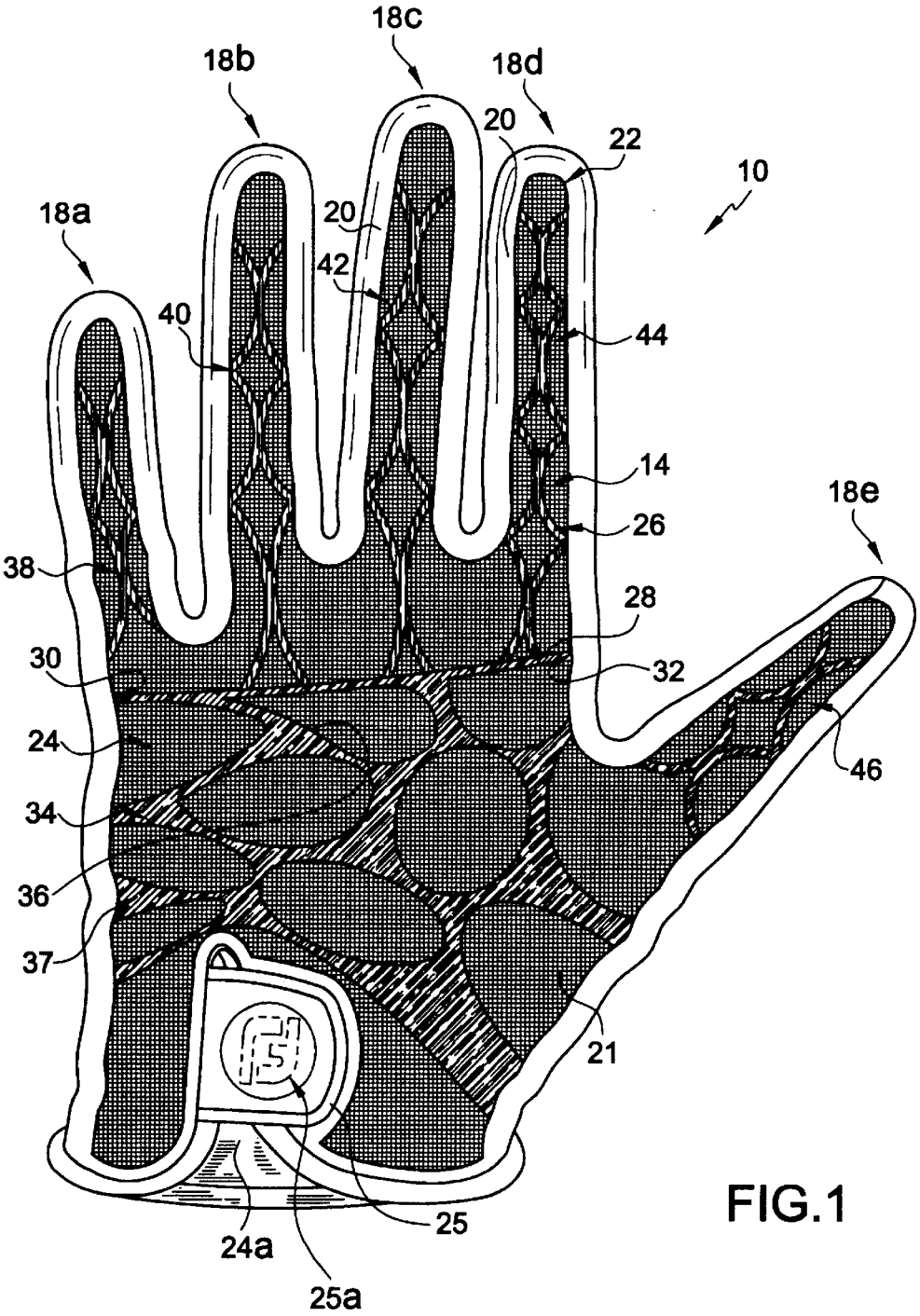
FIG. 1 is a back view of a glove according to a first embodiment of the present invention.
Figure 2:
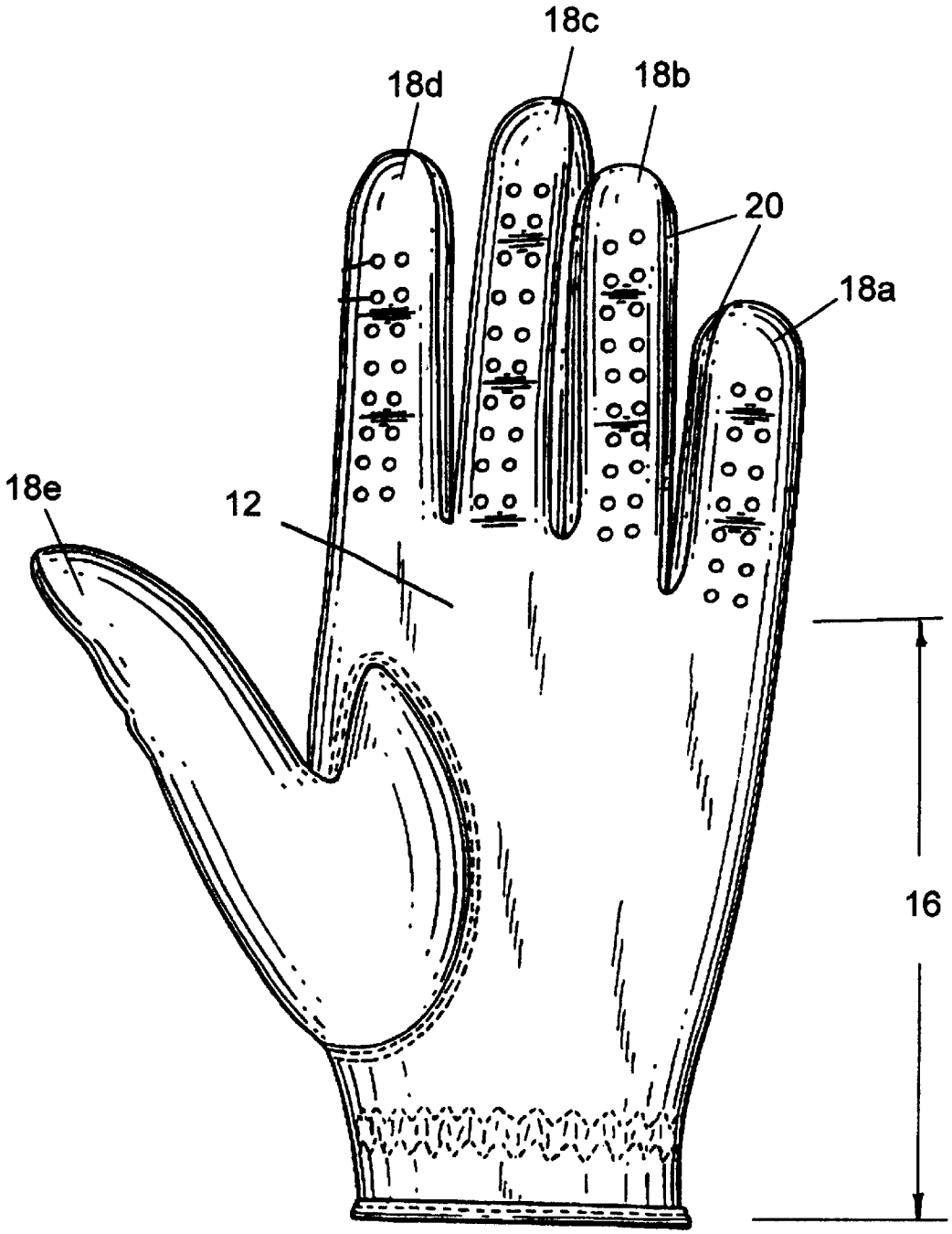
FIG. 2 is front view of the glove of FIG. 1.

Referring to FIGS. 1–2, a golf glove 10 is shown. Golf glove 10 includes a front portion 12 and a back portion 14. The front portion 12 includes a palm portion 16 and a plurality of finger portions 18*a–e* extending there from. The finger portions 18*a–e* include thumb portion 18*e*. In this embodiment, the palm portion 16 and finger portions 18*a–d* are formed of a single piece of material and the separate thumb portion is joined to the palm portion 16 by stitching. The thumb portion 18*e*, however, can be joined to the palm portion 16 using other techniques such as gluing.

In another embodiment, the palm and finger portions can be provided in any number of pieces then joined together. For example, a single piece can include the palm portion 16 and the finger portions 18*a–e*.

The front portion 12 is formed of a material that is preferably substantially inelastic, and may be leather, synthetic leather, other non-woven materials, natural fabric, or synthetic fabric, among others. Suitable leather materials include deerskin, doeskin, or steer hide, among others. Suitable non-woven materials include nylon, nylon-acrylic, neoprene, or terrycloth, among others. Other thermoplastic materials can also be used.

In one preferred embodiment, leather is used to provide good wear resistance while still providing good "feel." In one embodiment, the leather used can be modified to provide a surface appearance having a continuous pattern of smooth grain and discontinuous roughened areas. This modification provides improved grip characteristics under certain conditions and facilitates removal of liquids, such as water, from the surface. There are numerous ways of achieving this effect, which are well known to those of ordinary skill in this art. Such a product is available from Pittards plc, Sherborne Road, Yeovil, Somerset BA21 5BA, Great Britain. Preferred materials are PITTARDS DIGITAL LEATHER® that has the appearance of fake or artificial snake skin, which imparts an intriguing look to the glove while maintaining the desired physical properties, such as good wear resistance.

Referring to FIGS. 1 and 2, the glove 10 further includes fourchettes 20 coupled to the finger portions 18*a–e* and palm portion 16 to define a cavity 22 configured and dimensioned like a portion of a user's hand. The fourchettes are optional depending on the configuration and dimensions of the back portion 14 of the glove. Preferably, the glove 10 includes fourchettes so that the material on the sides of the user's fingers is smooth to allow easy grip of the club and prevent discomfort when moving the fingers. Furthermore, the fourchettes are preferably formed of substantially inelastic materials similar to those used for the front portion 12, however, substantially elastic materials may be used for the fourchettes with the proper the configuration and dimensions of the glove to allow for the proper fit.

Referring to FIG. 1, the back portion 14 of the glove 10 is formed of a first layer 24 of substantially elastic material coupled to the fourchettes 20 and palm portion 16 to form a chamber for receiving a user's hand. The connection between the first layer 24 and the front portion and fourchettes of the glove is substantially continuous rather than at discrete points. This connection is achieved by stitching however other techniques such as bonding or adhesive can also be used. The elastomeric, or elastic material, used for layer 24 is preferably a one-way stretch material, and more preferably a two-way stretch material. The first layer material 24 has interstices 21 with a small area less than about 1 $mm^2$.

The elastic material for layer 24 may be disposed in the glove to provide stretch in various directions, but it preferably provides at least thumb to pinkie stretch across the back of the wearer's hand. In the fingers, it is preferred that a one-way elastic material stretch lengthwise down the finger over the knuckle as the finger is bent, although a one-way material that stretches across each knuckle also provides a suitable glove fit. The elastic material for the first layer 24 preferably breathes to decrease the sweatiness and possible overheating of an athlete's hands in the glove. The material is preferably a mesh to provide an enhanced snug fit, more preferably an elasticated mesh formed of LYCRA® available from available from E. I. DuPont de Nemours & Co and or Spandex. In addition, preferably the first layer 24 has a thickness less than 2 mm so that the material is comfortable to the wearer.

One preferred elastic material for the first layer 24 can be G8TM, a 2-layer 1-way stretch satin-backed material, also available from Avon Tape, Inc located in Brockton, Mass. This smooth material enhances the smoothness of the glove against the hand. The most preferred material due to its superior wear and stretch characteristics is elasticated mesh G6TM, which has a controlled 2-way stretch combination of nylon and polyester and is available from Avon Tape, Inc.

Referring again to FIG. 1, the first layer 24 further includes a slit 24*a* for simplifying insertion of the wearer's hand into the glove. Across this slit, a hook and loop-type closure member 25, with optional indicia 25*a* is preferably added to fasten the glove firmly together to prevent slippage of the glove once placed on the hand.

The use of the elastic materials of the present invention along the back portion of the hand to provide enhanced fit permits the use of a stiffer, more wear resistant material to construct the remainder of the glove than was possible in the prior art. A non-woven material, as discussed above, is preferably used for the glove front portion 12, as shown in FIG. 2, although the specific materials may be independently selected.

Referring to FIG. 1, the back portion 14 further includes a second layer 26 of elastic material overlying at least a portion of the first layer 24 of elastic material. Preferably, the width of the back portion layers 24 and 26 is less than the width of the user's finger or hand so that the back portion stretches the front portion tightly across the user's palm and fingers. In addition, preferably the second layer 26 is thin for example having a thickness of less than 2 mm so that the material overlying the hands when gripping an object is comfortable to the wearer.

Preferably, the total area of the second layer 26 is less than about 50% of the total area of the first layer 24. More preferably, the total area of the second layer 26 is less than about 20% of the total area of the first layer 24. In this embodiment, the total area of the second layer 26 is about 5% of the total area of the first layer 24. The second layer 26 preferably forms an exoskeleton layer of the glove.

The second layer 26 is preferably formed of a plurality of elastic members or ribs. Each rib has a length and a width, where the length is greater than the width. A main rib 28 extends substantially across the entire back portion 14 of the glove, and is preferably coupled to the front portion 12 (as shown in FIG. 2) at discrete points 30 and 32. A plurality of lower ribs 34 extend downward from the main rib 28 and are coupled to the front portion at discrete spaced apart points. The ribs maybe coupled to the front portion only at discrete points by bonding, stitching, adhesion or the like. There is space between these discrete points of where the layer 26 is not coupled to the front portion of the glove.

The main rib 28 and lower ribs 34 form a set of ribs that extend across the back portion and create a network with interstices 36 and 37 of open area there between. Interstices 36 are completely surrounded by ribs 28 and/or 34, and interstices 37 are partially surrounded by ribs 28 and/or 34. The first layer 24 is visible through the interstices 36 and 37. The area of each interstice 36, 37 is substantially greater than the area between interstices 21 of the first layer 24 material and greater than about 2 mm. Since the first layer 24 is visible through the interstices 36 and 37, the first layer 24 can be the same or a different color from that of the second layer 26.

A plurality of upper ribs 38–46 extend along each of the finger portions 18*a–e* respectively and form a second set of elastic members. Upper ribs 38 extending along the little finger portion 18*a* are preferably disconnected from the main rib 28, but coupled to the front portion at discrete points. Upper ribs 40 extending along the ring finger portion 18*b* are preferably connected to the main rib 28, and coupled to the front portion at discrete points. Upper ribs 42 extending along the middle finger portion 18*c* are preferably connected to the main rib 28 and coupled to the front portion at discrete points. Upper ribs 44 extending along the index finger portion 18*d* are preferably connected to the main rib 28 and coupled to the front portion at discrete points. Upper ribs 46 extending along the thumb portion 18*e* are preferably disconnected from the main rib 28, but coupled to the front portion at discrete points.

In this embodiment, the upper ribs 40–44, the main rib 28, and lower ribs 34 are formed of a single piece of material. The upper ribs 38 and 46 are each formed as separate pieces of material. The second layer 26 is preferably formed by molding, however this layer can also be formed using various weaving or non-woven material forming techniques depending on the material selected.

Alternatively, the second layer 26 can be formed as a single piece including all of the upper ribs 38–46, the main rib 28 and lower ribs 34 or the second layer can be formed with less than all of the upper ribs 38–46 formed as a single piece, or the upper ribs 38–46 can all be separate from the main rib 28. In addition, the length of the upper ribs can be modified so that they extend up a lesser or greater percentage of the associated finger portion and the individual ribs making up the upper ribs 38–46 themselves can be formed as separate pieces. In an alternative embodiment, the glove may include a plurality of elastic members that extend only along at least one of the finger portions or no finger portions or no lower ribs.

The coupling of the second layer 26 to the front portion 12 can be by stitching directly to the front portion, or to fourchettes by stitching to the first layer 24 that in turn is connected to the front portion. Additionally the second layer 26 can be sandwiched between the first layer 24 and the front portion 12 and these three components can be stitched together simultaneously. Alternatives to stitching like adhesive can also be used.

In one embodiment, the bottom surface of the second layer 26 can be secured to the first layer 24 so that the layers 24 and 26 cannot move with respect to one another. This can be achieved for example by bonding substantially the entire bottom surface of the second layer 26 to the first layer or by bonding the bottom surface of at least one elastic member of second layer 26 to first layer 24. In another embodiment, the second layer 26 can be separate from the first layer so that they are not secured together. As a result, layers 24 and 26 may be free to move with respect to one another.

The first and second layers 24 and 26 can be formed of woven material, non-woven material, neoprene, or polyester urea, among others. A preferable polyester urea is LYCRA® available from E. I. DuPont de Nemours & Co. Polyester urea is a polymeric material, and other such materials can be used for the second layer. More preferably, the second layer 26 is formed of a molded material.

Figure 3:
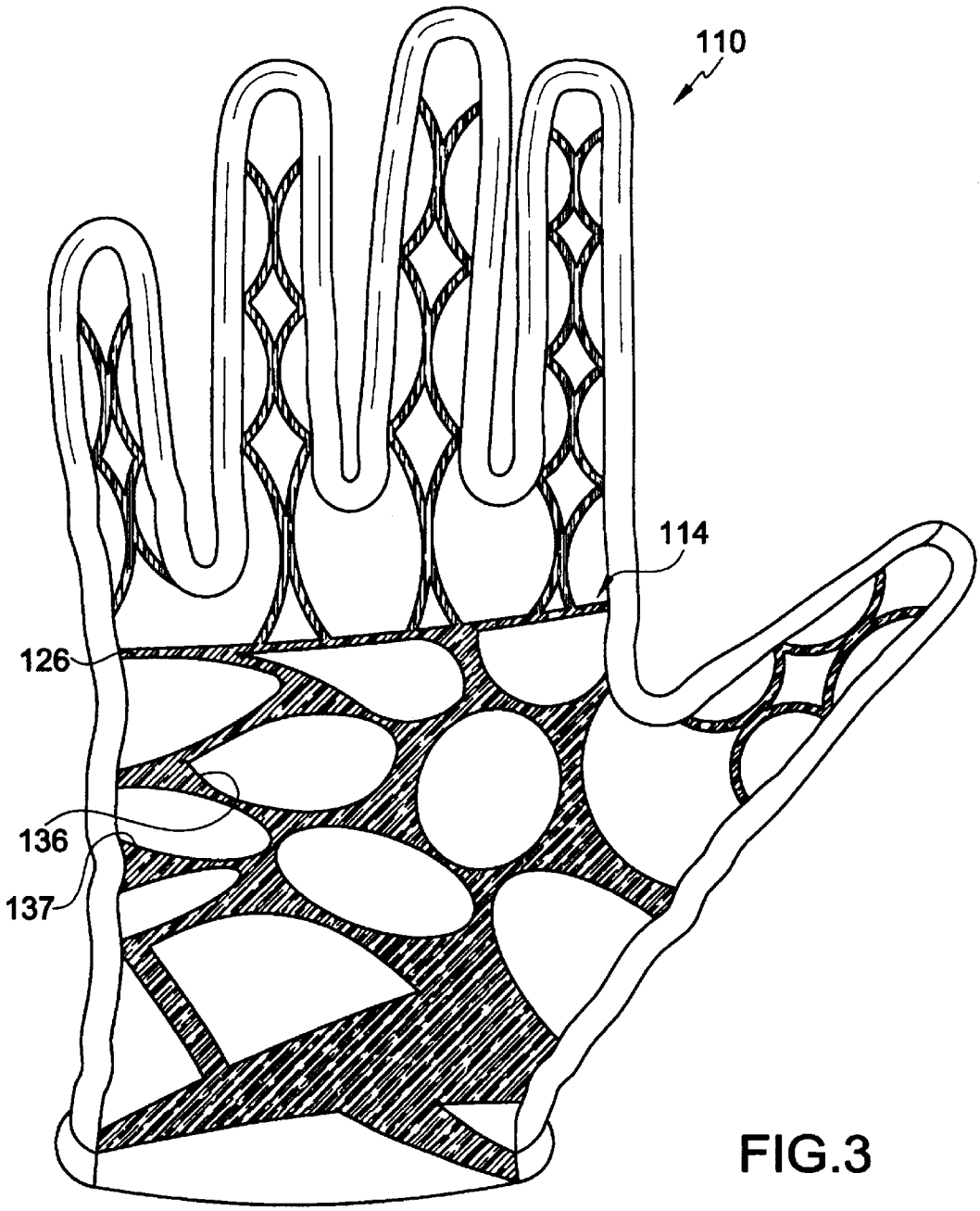
FIG. 3 is a back view of a glove according to a second embodiment of the present invention.

Referring to FIG. 3, a second embodiment of a glove 110 is shown. The glove 110 is similar to the glove 10 discussed above. The back portion 114 is formed of a single layer 126 of ribs of elastic material. The layer 126 is in a network so that interstices 136, 137 are formed. The geometry of layer 126 can be modified and the present invention is not limited to this configuration. Since the back portion 114 is a single layer, when a user's hand is within the glove their hand is visible through the interstices 136, 137. In this embodiment, there is no substantially closed chamber in which the user's hand is located. The second layer 126 contacts the user's hand and should have a bottom surface that is smooth or soft so that the layer 126 is comfortable to the wearer. The necessary smoothness or softness of the bottom surface of the second layer 126 can be achieved by selecting the appropriate material or by using finishing techniques on the material. The materials for forming the various components of the glove 110 are similar to those that form the glove 10.

Figure 4:
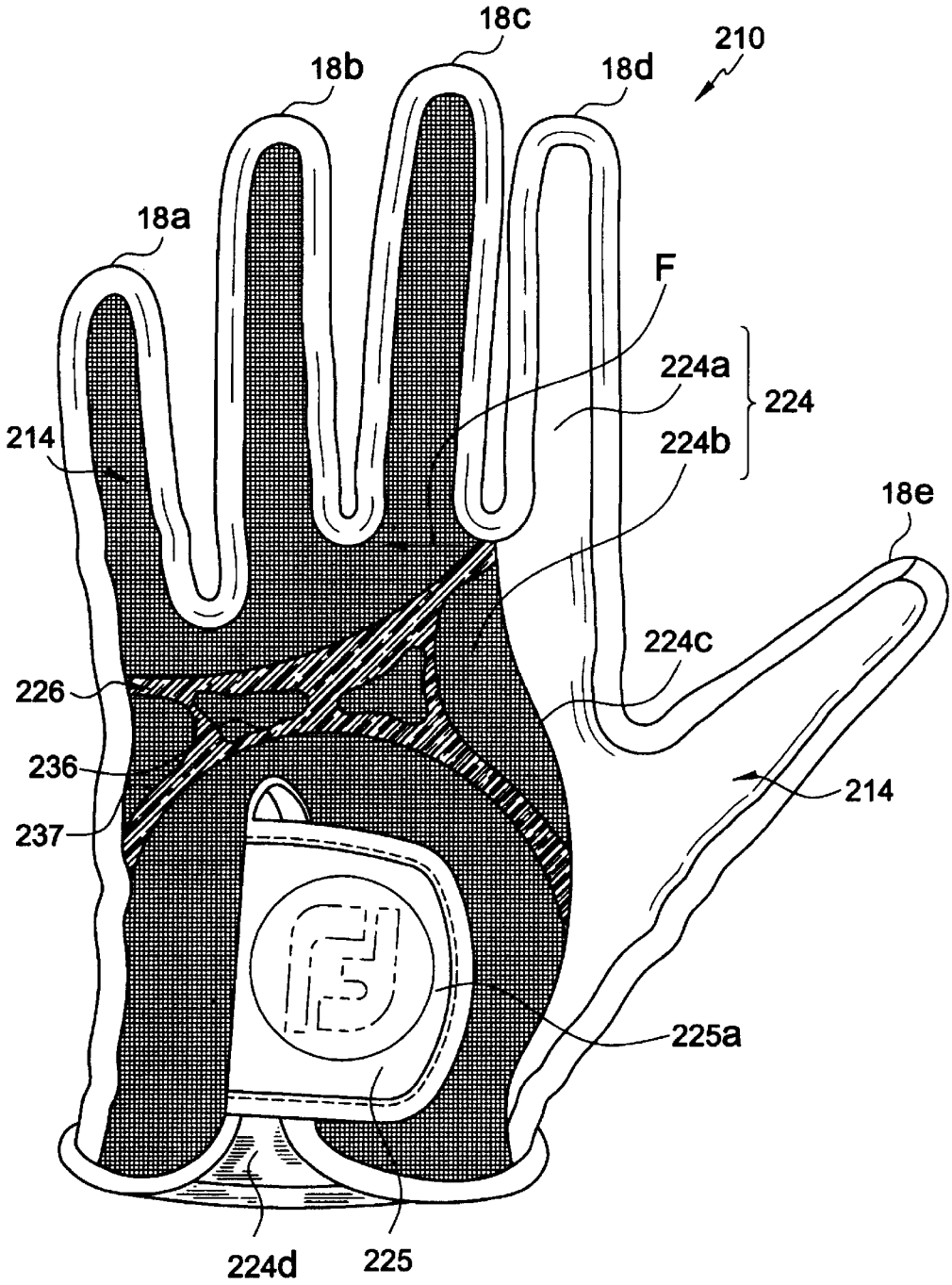
FIG. 4 is a back view of a glove according to a third embodiment of the present invention.

Referring to FIG. 4, a fourth embodiment of a glove 210 is shown. The glove 210 is similar to the glove 10 discussed above. A first layer 224 of back portion 214 is formed of two pieces of material. First piece 224*a* preferably extends from the back of the hand along the index finger portion 18*d* and the thumb portion 18*e*. Alternatively, first piece 224*a* may extend along any one or more of the finger portions 18*a–e*. This first piece 224*a* is formed of a substantially inelastic material, similar to the materials that form the front portion 12 of glove 10. The second piece 224*b* of the first layer 224 is preferably joined to the first piece 224*a* by stitching along seam 224*c*. The second piece 224*b* is formed of a substantially elastic material similar to the materials that form the first layer 24 of glove 10. The second piece 224*b* further includes a slit 224*d*, closure member 225, and indicia 225*a* similar to glove 10.

The back portion 214 further includes a second layer 226 formed of ribs of elastic material. The second layer 226 is preferably connected to the first layer 224 at discrete points on the seam 224*c* and along an opposite edge of first layer 224. The second layer 226 is configured and dimensioned to provide an elastic force F from the index finger portion 18*d* towards the ring finger portion 18*b*. This force F, when a user's hand is gripping a golf club properly, would be substantially linear to a club shaft to provide a sense of security to the user with respect to the glove's fit.

The second layer 226 is formed of similar materials to those that form the second layer 26 of glove 10. The layer 226 is a network so that interstices 236, 237 are formed. The glove 210 can alternatively be formed with a different geometry of the second layer 226 and/or the glove 210 can be formed without the layer piece 224*b* so that the layer 226 connects directly to the piece 224*a* and the user's hand is visible through the interstices 236, 237. The second layer 226 in this embodiment, can be modified for example to have lower ribs and/or upper ribs or to connect to other areas of the seam.

While various descriptions of the present invention are described above, it is understood that the various features of the present invention can be used singly or in combination thereof. For example, the glove layer with ribs can be formed of any geometry. The glove described above is particularly useful as a golf glove however the concepts of the present invention can be used in other gloves such as dress gloves, and other sports gloves, for example, baseball gloves, skiing gloves, and football gloves. In another embodiment, logos or indicia can be formed on the first and second layers by methods such as stitching, printing, silkscreening, or the like. The features of one embodiment can be used with the features of another embodiment. Therefore, this invention is not to be limited to the specifically preferred embodiments depicted therein.

What is claimed is:

1. A glove comprising:

a substantially inelastic front portion; and a back portion coupled to the front portion and comprised of a first substantially elastic material covering a substantial portion of a back of a hand, and a second substantially elastic material including a plurality of substantially elastic rib members having a length greater than a width such that the rib members extend substantially across the entire back portion and couple to the front portion at discrete points, wherein the first elastic material forms a first layer and the second elastic material forms a second layer overlaying less than 50% of the first layer.

2. The glove of claim 1, wherein the elastic rib members cover less than about 20% of the first substantially elastic material.

3. The glove of claim 1, wherein the front portion further includes a palm portion and finger portions extending from the palm portion.

4. The glove of claim 3, wherein the plurality of elastic rib members include a plurality of finger rib members that extend across a back portion of at least one of the finger portions.

5. The glove of claim 4, wherein the first elastic material extends along at least one of the finger portions.

6. The glove of claim 3, wherein the plurality of elastic rib members includes at least two sets of elastic rib members, the first set of elastic rib members extends across the back portion and the second set of elastic rib members extends across a back portion of the at least one of the finger portions.

7. The glove of claim 6, wherein first and second sets of elastic rib members are coupled together.

8. The glove of claim 7, further including at least one additional set of elastic rib members that extends across a back portion of at least one remaining finger portion.

9. The glove of claim 6, further including four additional sets of elastic rib members that extend across a back portion of each of the remaining finger portions.

10. The glove of claim 9, wherein at least one of the second or additional sets of elastic rib members are separate from the first set of elastic rib members.

11. The glove of claim 1, wherein the front portion is formed of a material selected from the following group: leather, synthetic leather, non-woven material, natural fabric, and synthetic fabric.

12. The glove of claim 1, wherein the first material is a woven material or non-woven material made from an elastic material comprising one of the following: neoprene, LYCRA, Spandex, and polyester.

13. A glove comprising:

a substantially inelastic front portion; and a back portion coupled to the front portion and comprised of a first substantially elastic material, and a second substantially elastic material including a plurality of substantially elastic members, wherein the front portion further includes a palm portion and finger portions extending from the palm portion, wherein the plurality of elastic members includes at least two sets of elastic members, the first set of elastic members extends across the back portion and the second set of elastic members extends across at least one of the finger portions, and wherein first and second sets of elastic members are formed of a single piece of material.

* * * * *